US005135266A

United States Patent [19]

Bridges et al.

[11] Patent Number: 5,135,266

[45] Date of Patent: Aug. 4, 1992

[54] CASING SLIPS AND SEAL MEMBER

[75] Inventors: Charles D. Bridges, Cypress; Henry Lang, Woodland, both of Tex.

[73] Assignee: ABB Vetco Gray Inc., Houston, Tex.

[21] Appl. No.: 736,655

[22] Filed: Jul. 26, 1991

Related U.S. Application Data

[63] Continuation-in-part of Ser. No. 605,731, Oct. 30, 1990, abandoned.

[51] Int. Cl.[5] ..... E21B 19/10

[52] U.S. Cl. ..... 285/144; 285/146; 285/148; 285/341

[58] Field of Search ..... 285/144–148, 285/321, 342; 175/423

[56] References Cited

U.S. PATENT DOCUMENTS

| | | | |
|---|---|---|---|
| 1,604,580 | 10/1926 | Jaques . | |
| 1,654,463 | 12/1927 | Jaques . | |
| 1,855,350 | 4/1932 | Humason . | |
| 1,875,749 | 9/1932 | McEvoy et al. . | |
| 1,973,809 | 9/1934 | Heggem . | |
| 2,137,853 | 11/1938 | Nixon . | |
| 2,493,556 | 1/1950 | Stone . | |
| 2,507,261 | 5/1950 | Mercier | 28/341 |
| 2,624,413 | 1/1953 | Mueller et al. . | |
| 2,775,471 | 12/1956 | Douglass . | |
| 2,824,757 | 2/1958 | Rhodes . | |
| 2,850,301 | 9/1958 | Allen | 285/148 |
| 3,051,513 | 8/1962 | Watts et al. . | |
| 3,092,405 | 6/1963 | Wurzburger . | |
| 3,127,198 | 3/1964 | Orund . | |
| 3,233,926 | 2/1966 | Walterscheid-Muller . | |
| 3,248,132 | 4/1966 | Pierce, Jr. . | |
| 4,323,727 | 4/1982 | Berg . | |
| 4,330,143 | 5/1982 | Reneau . | |

FOREIGN PATENT DOCUMENTS

| | | |
|---|---|---|
| 718976 | 11/1954 | United Kingdom . |
| 821776 | 10/1959 | United Kingdom . |

*Primary Examiner*—Michael F. Trettel
*Attorney, Agent, or Firm*—James E. Bradley

[57] ABSTRACT

A method and an apparatus for attaching an upper wellhead housing to casing employs a combination slip and seal assembly. An annular metal slip member is supported by a lower wellhead housing. The slip member has a conical section with an annular external seal. The interior of the slip member contains circumferential teeth. When the upper wellhead housing is placed over the slip member and clamped to the lower wellhead housing, it wedges the slip member radially inward. The internal teeth will embed against the casing to grip the casing. The external seal seals against the upper wellhead housing bore conical surface. A retaining ring engages the slip member and locates between mating shoulders of the upper and lower housings to limit downward travel of the slip member.

9 Claims, 3 Drawing Sheets

31
33
23
47
27
35
29
39
43
37
17
25
41
45
21
49
51
53
19
15
13
11

CASING SLIPS AND SEAL MEMBER

CROSS REFERENCE TO RELATED APPLICATION

This application is a continuation-in-part of application Ser. No. 07/605,731 filed Oct. 30, 1990, entitled CASING SLIPS AND SEAL MEMBER, now abandoned, inventors Charles D. Bridges and Henry Lang.

BACKGROUND OF THE INVENTION

1. Field of the invention

This invention relates in general to wellhead assemblies, and in particular to an apparatus for supporting and sealing casing in a wellhead.

2. Description of the Prior Art

There are many types of wellhead assemblies. When drilling a well, surface casing will be set to a selected depth below the surface. Often, a starter head will be attached to this surface casing. The starter head is typically attached by welding, threading, or hydraulic crimping. Welding is time consuming and may leak if not done properly. The hydraulic crimping operations require expensive equipment.

Slips are used in the prior art to support pipe within a housing for many purposes. Generally, slips will be segments having a wedge-shaped cross-section with teeth on the interior to qrip the pipe. Seals of various types are employed above the slips

SUMMARY OF THE INVENTION

A method and apparatus is employed with this invention for attaching a wellhead housing to surface casing. A lower wellhead housing is placed over the surface casing. The lower wellhead housing has an upward facing conical section. An annular slip member is placed in the conical section of the lower wellhead housing. The slip member has a lower conical section that lands on the conical section of the lower wellhead housing. The slip member has an upper exterior conical section, and an annular exterior seal. The interior of the slip member is cylindrical and contains a set of circumferential teeth. A seal is also located in the interior of the slip member.

The upper wellhead housing has a bore with a conical section that matches the conical section of the slip member. The upper member is placed over the slip member, then clamped to the lower wellhead housing. While clamping, the upper wellhead housing and lower wellhead housing will move toward each other. The slip member cannot move once it is in tight contact with the lower wellhead housing. This creates a wedging action which deflects the slip member inward. The teeth will embed into the casing. The exterior seal on the slip conical section will seal in the bore of the upper wellhead housing.

In a second embodiment, a retaining ring locates in an annular recess on the exterior of the slip member between the upper and lower conical sections. The ring protrudes radially outward from the recess. The upper housing has a downward facing shoulder that engages the ring to push the slip member downward when the upper housing is clamped to the lower housing. The lower housing has an upward facing shoulder that is contacted by the ring, stopping downward travel of the slip member when fully set.

DETAILED DESCRIPTION OF THE INVENTION

Figure 1:
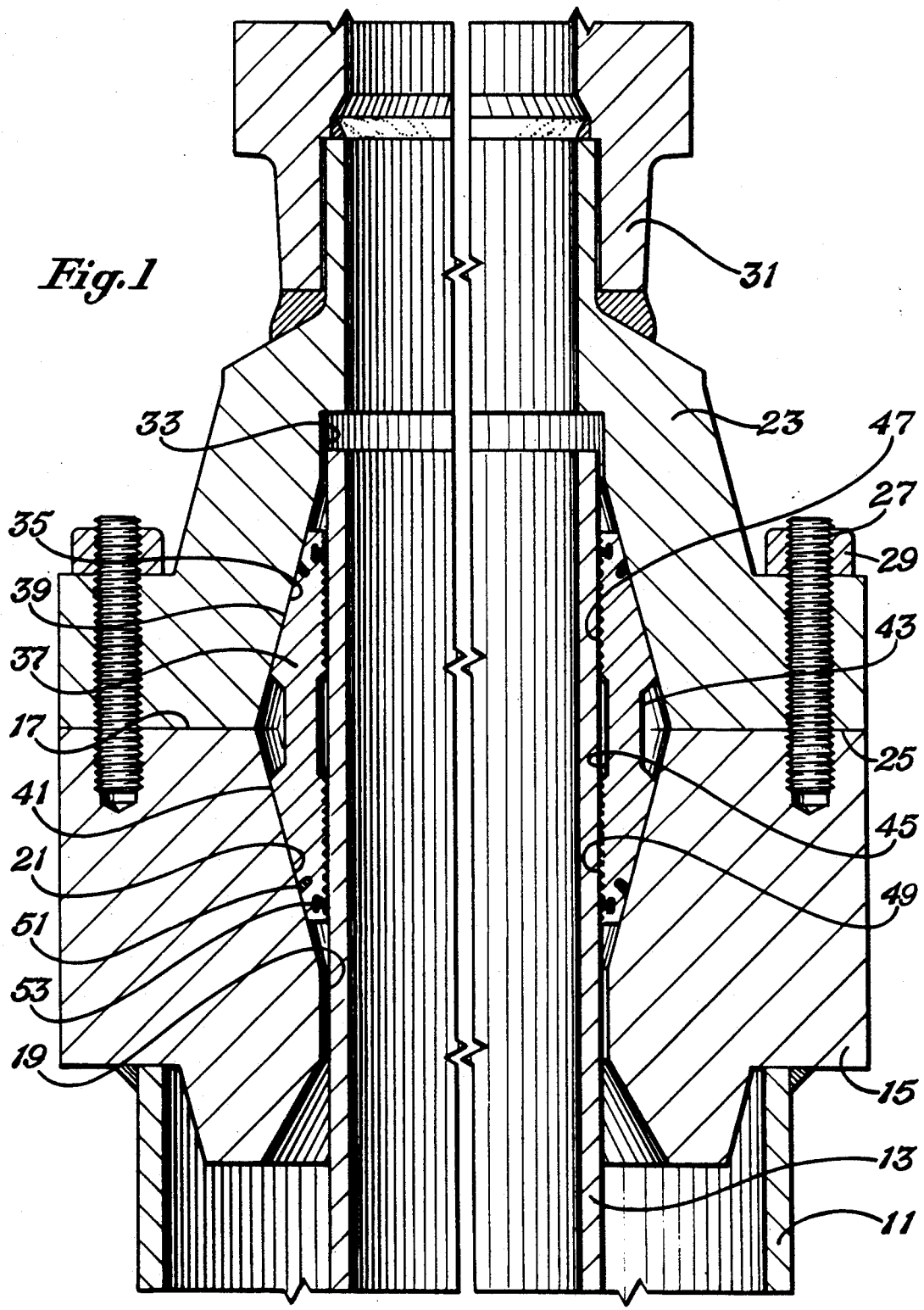
FIG. 1 shows a wellhead apparatus constructed in accordance with this invention.

The well may have large diameter conductor pipe 11 extending into the well a short distance. The conductor pipe 11 is cylindrical. A string of surface casing 13 will extend into the well a greater depth. Casing 13 is also cylindrical. The upper end of casing 13 will be cut a short distance above the upper end of the conductor pipe 11.

A lower wellhead housing 15 may be secured to the conductor pipe 11, such as by welding. The lower wellhead housing 15, is a flange member. It has a flat upper end 17. A bore 19 extends axially through the lower wellhead housing 15, concentric with the axis of the conductor pipe 11. Bore 19 surrounds the casing 13, but does not touch it. A conical section 21 extends from the upper end 17 downward a selected distance. The conical section 21 tapers downward, having a larger diameter at its upper end than at its lower extent.

An upper wellhead housing 23 will connect to the lower wellhead housing 15. Upper wellhead housing 23 has a flat lower end 25 that abuts the upper end 17 of the lower wellhead housing 15. Threaded rods 27 extend through holes in the upper wellhead housing 23. Nuts 29 serve as means along with rods 27 for clamping the upper wellhead housing 23 to the lower wellhead housing 15. An upper tubular member 31 of conventional nature may be mounted to the upper wellhead housing 23 for supporting a smaller diameter string of casing (not shown).

Upper wellhead housing 23 has a bore 33 extending axially through it. A conical section 35 extends upward from the lower end 25. Conical section 35 tapers upward, having a larger diameter lower end than its upper extent. In the embodiment shown, the degree of taper of the bore conical sections 21 and 35 is the same.

A slip member 37 locates between the upper wellhead housing 23 and lower wellhead housing 15. Slip member 37 provides a seal in the annular space between the upper wellhead housing 23 and the casing 13. Slip member 37 also grips the casing 13 to prevent axial movement between the casing 13 and the upper and lower wellhead housings 23, 15.

Figure 2:
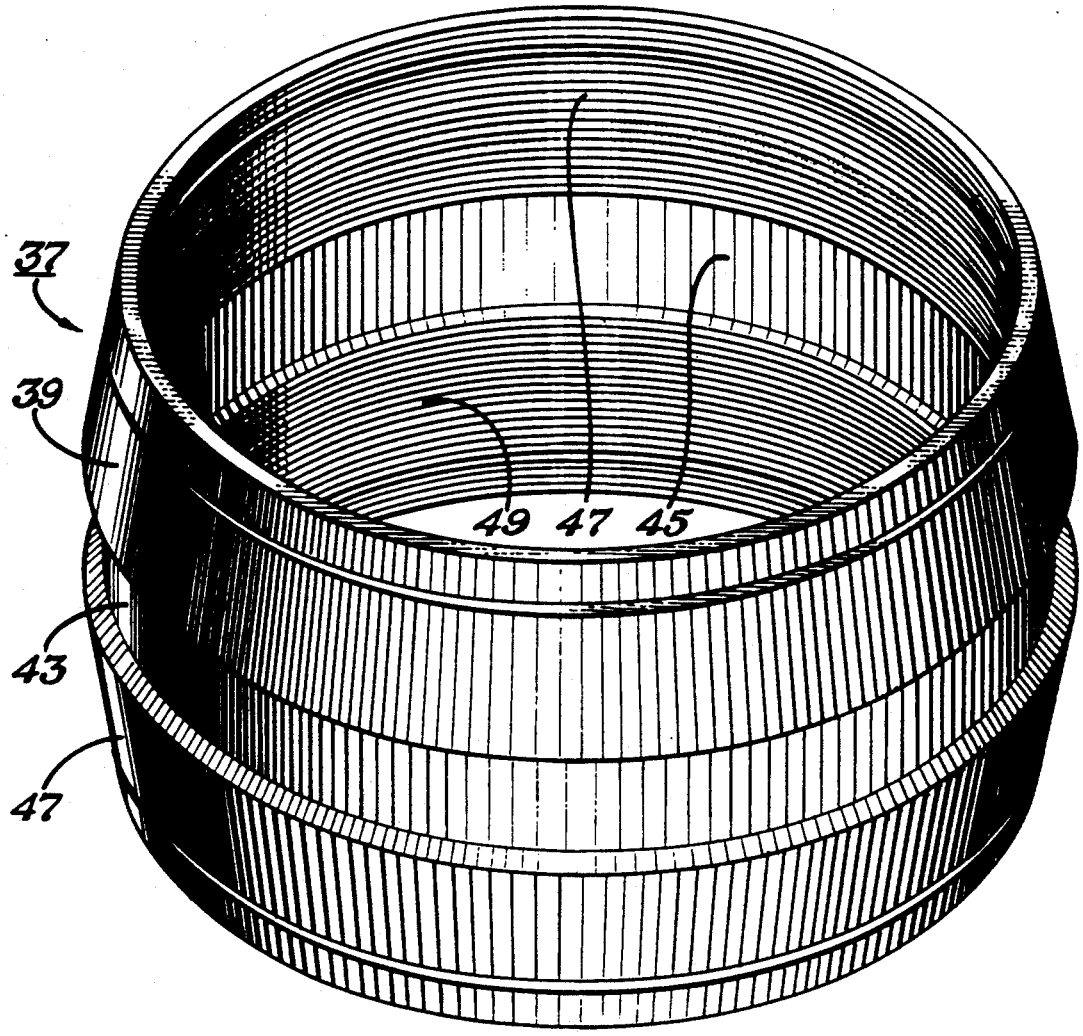
FIG. 2 is a perspective view of the slip and seal member utilized with the wellhead apparatus of FIG. 1.
Figure 3:
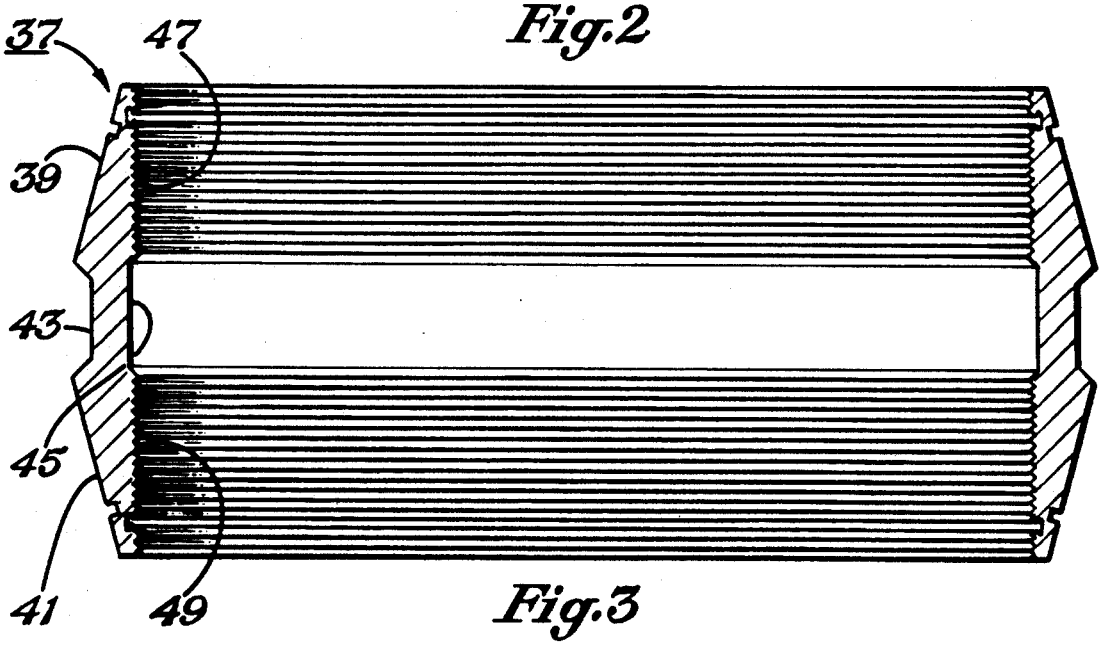
FIG. 3 is a sectional view of the slip and seal member of FIG. 2.

As shown in FIGS. 2 and 3, slip member 37 has an exterior upper conical section 39. The upper conical section 39 tapers upward, having a larger outer diameter on its lower end than on its upper end. The upper conical section 39 has the same degree of taper as the upper wellhead housing conical section 35. The upper conical section 39 is a smooth conical surface for contact with the upper wellhead housing conical section 35.

In the embodiment shown, slip member 37 also has a lower conical section 41 on its exterior. Lower conical section 41 tapers downward, having a larger outer diameter at its upper extent than at its lower extent.

Lower conical section 41 has the same degree of taper as the lower wellhead housing conical section 21. Lower conical section 41 is a smooth conical surface for contact with the lower wellhead housing conical section 21.

A midsection comprising an exterior recess 43 and an interior recess 45 locates between the upper and lower conical sections 39, 41. The recesses 43, 45 are annular. The radial wall thickness of the midsection at the recesses 43, 45 is less than the wall thickness of the upper conical section 35 at its lower end, and less than the lower conical section 41 at its upper end.

The interior of slip member 37 is cylindrical. Two sets of teeth 47, 49 are formed in the interior. The upper teeth 47 and the lower teeth 49 both comprise circumferential grooves, each groove located in a plane perpendicular to the axis of the slip member 37. In the preferred embodiment, each tooth of the sets of teeth 47, 49 is triangular in shape, having 45 degree upper and lower flanks. The root between the flank of one of the teeth 47, 49 and an adjacent one is curved The inner recess 45 separates the upper teeth 47 from the lower teeth 49.

The slip member 37 is a solid continuous annular member. There are no vertical splits in slip member 37. Slip member 37 is of a steel material, preferably having a yield strength of about 60,000 pounds per square inch. In the embodiment shown, outer and inner elastomeric seals 51, 53 (FIG. 1) are employed. Outer elastomeric seals 51 locate on the exterior of slip member 37. One of the outer elastomeric seals 51 is located near the upper end of the upper conical section 39, while the other elastomeric seal 51 is located near the lower end of the lower conical section 41. Similarly, one of the inner elastomeric seals 53 is located near the upper end of the upper teeth 47. The other inner elastomeric seal 53 is located near the lower end of the lower teeth 49. The outer seals 51 seal against the conical sections 21, 35, while the inner seals 53 seal against the casing 13.

In operation, the conductor pipe 11 may be installed in the well. The lower wellhead housing 15 will be welded to the conductor pipe 11. The casing 13 will be lowered into the well and cemented in place once the well has been drilled to the desired surface casing depth.

The casing 13 will be cut off to a desired height. The slip member 37 will be placed around the casing 13 and in the lower wellhead housing conical section 21. The upper wellhead housing 23 will be placed over the casing 13, slip member 37 and lower wellhead housing 15. The upper wellhead housing conical section 35 will contact the slip member upper conical section 39.

Nuts 29 will be tightened. This draws the upper wellhead housing 23 downward toward the lower wellhead housing 15, without rotation There will be some initial sliding engagement of the lower conical section 41 with the lower wellhead housing conical section 21 as the upper wellhead housing 23 pushes downward on the slip member 37. Once the slip member 37 wedges against the lower wellhead housing 15, the upper wellhead housing 23 will move downward relative to the slip member 37.

The downward movement of the upper wellhead housing 23 causes sliding engagement of the upper wellhead housing conical section 35 against the slip member upper conical section 39. The wedging action will cause radial deflection of the slip member 37. The upper conical section 39 will move radially inward, causing the upper teeth 47 to embed into the casing 13. The lower conical section 41 will also move radially inward, causing the teeth 49 to embed in the casing 13. The midsection recesses 43, 45 facilitate in this radial inward deflection. The deflection is not enough to permanently deform the slip member 37, rather the deflection is within the elastic limits of the material of the slip member 37. The amount of deflection will typically be about a 0.060 inch decrease in diameter from the initial position to the set position for 20 inch diameter casing 13.

Once the nuts 27 have been fully tightened, elastomeric sealing engagement will occur between the upper outer seal 51 and the upper wellhead housing conical section 35. Additionally, the upper inner elastomeric seal 53 will seal against the casing 13. Although not necessary, similar sealing will occur with the lower outer seal 51 against the lower wellhead housing conical section 21. Similar sealing will occur with the lower inner seal 53 against the casing 13. Additionally, the teeth 47, 49 will grip the casing 13 to prevent any axial movement of casing 13 relative to the upper and lower wellhead housings 23, 15

Figure 4:
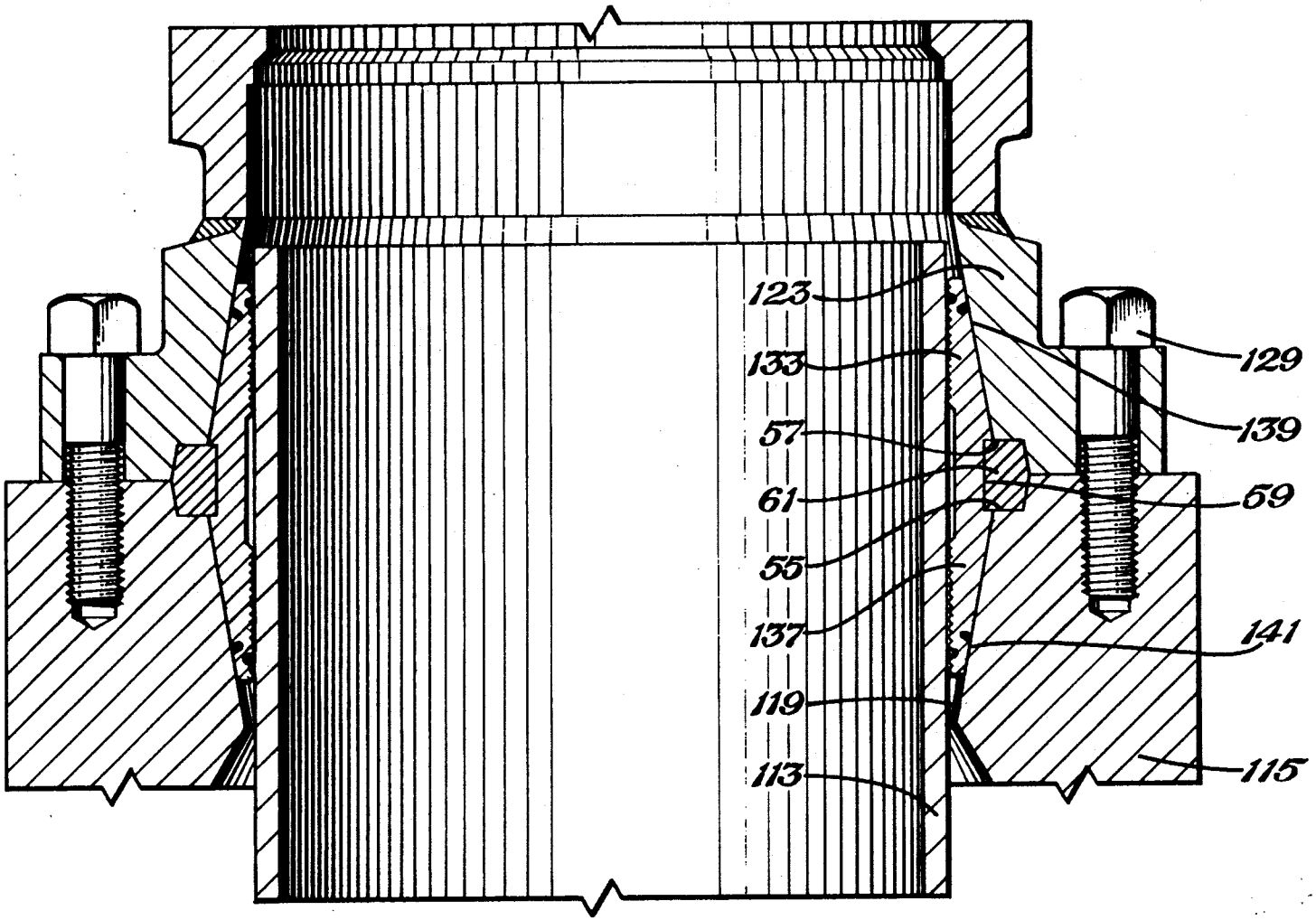
FIG. 4 is a sectional view of a second embodiment of a wellhead apparatus constructed in accordance with this invention.

In the alternate embodiment of FIG. 4, a means is provided to prevent the application of too much radial force as the slip member 137 is set. Excessive radial force might cause the casing 113 to collapse. A stop is provided which will limit the downward travel of slip member 137 during setting. The stop includes an upward facing shoulder 55 located in bore 119 of lower wellhead 115. Upward facing shoulder 55 is perpendicular to the axis of bore 119. Upward facing shoulder 55 is located at the upper end of lower wellhead 115. Upward facing shoulder 55 is formed by machining a counterbore in the bore 119 at the termination of bore 119.

A similar downward facing shoulder 57 is formed in bore 133 of upper wellhead 123. Downward facing shoulder 57 is located at the lower end of upper housing 123. The shoulders 55, 57 define an annular cavity when the upper wellhead 123 is clamped to the lower wellhead 115.

A mating recess 59 is formed on the exterior of slip member 137. Recess 59 is rectangular in vertical cross section. The recess 159 has a lesser radial dimension than the shoulders 55, 57. Recess 59 is located in the vertical midsection of slip member 137, between the upper conical section 139 and lower conical section 141. When slip member 137 is in the set position, as shown in FIG. 4, recess 59 will align with shoulders 55, 57 to define an annular cavity that is generally rectangular in cross section A retaining ring 61 is installed in recess 59 prior to installing slip member 137 in the wellheads 115, 123. Retaining ring 61 is a metal ring that is split so as to allow its installation. Once installed, it will fit closely within the recess 59. Retaining ring 61 has a radial width that is substantially the same as the radial dimension from recess 59 to the outer edges of shoulders 55, 57. As a result, retaining ring 61 will protrude radially outward past the exterior of slip member 137. Retaining ring 61 will substantially fill the cavity defined by the shoulders 55, 57 and the recess 59.

In the operation of the second embodiment, retaining ring 61 will be installed in recess 59 of slip member 137. Slip member 137 will be placed in the lower wellhead 115. The retaining ring 61 will be initially spaced above the upward facing shoulder 55. The upper wellhead 123 will be placed over the slip member 137. Initially, the downward facing shoulder 57 will be spaced above the retaining ring 61.

The operator will begin to clamp the upper wellhead 123 to the lower wellhead 115 by rotating the nuts 129. The upper wellhead 123 will slide downward on the upper conical section 139. Similarly, the slip member 137 will slide downward in the lower wellhead 115. Eventually the downward facing shoulder 57 will contact the retaining ring 61 and exert a downward force. Then, when at the fully set position, the retaining ring 61 will contact the upward facing shoulder 55. This contact will stop further downward travel of the slip member 137. The upper wellhead 123 will be tightened to lower wellhead 115 at that point, with the upper and lower ends of the wellheads 115, 123 abutting each other.

The invention has significant advantages. The slip assembly both grips pipe and provides a seal. The wellhead housing attaches to the casing without the need for welding or hydraulic crimping. The retaining ring avoids collapsing the casing due to too high of a radial force during setting of the slip assembly.

While the invention has been shown in only one of its forms, it should be apparent to those skilled in the art that it is not so limited, but is susceptible to various changes without departing from the scope of the invention.

We claim:

1. A housing assembly for connection to conduit of a well, comprising in combination:

a lower housing having an upper end and a bore with a lower internal conical section extending downward from the upper end;

an upper housing having a lower end and a bore with an upper internal conical section extending upward from the lower end;

a metal slip member with an upper external conical section, a lower external conical section, and a cylindrical internal portion containing a set of teeth, the slip member being a continuous unbroken annular member;

an annular internal seal located in the cylindrical internal portion of the slip member;

the slip member being located around the conduit with the upper external conical section above the lower housing and the lower external conical section in mating contact with the lower internal conical section of the lower housing; and means for clamping the upper housing to the lower housing, causing the upper and lower housings to move toward each other without rotation and causing the upper internal conical section of the upper housing to slide downward on the upper external conical section of the slip member, for deflecting the slip member radially inward, forcing the teeth to embed in the conduit, and forming sealing engagement of the internal seal with the conduit.

2. The housing assembly according to claim 1, further comprising:

an external seal located in the external conical section of the slip member which seals to the internal conical section of the bore.

3. A housing assembly for connection to conduit of a well, comprising in combination:

a lower housing having an upper end and a bore with a lower internal conical section extending downward from the upper end;

an upper housing having a lower end and a bore with an upper internal conical section extending upward from the lower end;

a metal slip member with an upper external conical section, a lower external conical section, and a cylindrical internal portion containing a set of circumferential teeth, the slip member being a continuous annular member free of any vertical splits;

an upper external elastomeric seal located in the upper external conical section of the slip member;

a lower external elastomeric seal located in the lower external conical section of the slip member;

an inner elastomeric seal located in the internal portion of the slip member;

the slip member being located around the conduit with the upper external conical section above the lower housing and the lower external conical section in mating contact with the lower internal conical section of the lower housing; and means for clamping the upper housing to the lower housing, causing the upper housing to move downward without rotation onto the lower housing and causing the upper internal conical section of the upper housing to slide downward on the upper external conical section of the slip member, for deflecting the slip member radially inward, forcing the teeth to embed in the conduit, and forming sealing engagement of the upper external elastomeric seal with the upper internal conical section of the upper housing, forming sealing engagement of the lower external elastomeric seal with the lower internal conical section of the lower housing, and forming sealing engagement of the inner elastomeric seal with the conduit.

4. A housing assembly for connection to conduit of a well, comprising in combination:

a housing having a bore with an internal conical section converging downward;

a shoulder in the bore of the housing at the upper end of the conical section;

a metal slip member extending around the conduit, the slip member having an external conical section and an internal cylindrical portion containing a set of circumferential teeth, the slip member being a continuous annular member;

an annular internal seal in the internal cylindrical portion of the slip member;

an annular recess formed at the upper end of the conical section of the slip member;

a retaining ring located in the recess and protruding radially outward from the conical section of the slip member for engaging the shoulder of the housing; and means for forcing the slip member downward in the housing until the retaining ring lands on the shoulder, for deflecting the slip member radially inward, forcing the teeth to embed in the conduit, and forming sealing engagement of the internal seal with the conduit.

5. The assembly according to claim 4 further comprising:

an external seal located on the external conical section of the slip member for engaging the internal conical section of the bore of the housing.

6. A housing assembly for connection to conduit of a well, comprising in combination:

a lower housing having an upper end and a bore with a lower internal conical section extending downward from the upper end;

an upward facing annular shoulder in the bore at the upper end of the lower housing;

an upper housing having a lower end and a bore with an upper internal conical section extending upward from the lower end;

a downward facing annular shoulder at the lower end of the bore of the upper housing;

a metal slip member with an upper external conical section, a lower external conical section, and a cylindrical internal portion containing a set of teeth, the slip member being a continuous annular member;

an annular recess formed on the exterior of the slip member between the upper and lower external conical sections;

a retaining ring located in the annular recess and protruding radially outward for engaging the shoulders of the upper and lower housings;

the slip member being located around the conduit with the upper external conical section above the lower housing and the lower external conical section in mating contact with the lower internal conical section of the lower housing; and means for clamping the upper housing to the lower housing, causing the upper and lower housings to move toward each other without rotation and causing the upper internal conical section of the upper housing to slide downward on the upper external conical section of the slip member until the retaining ring is engaged by the shoulder of the upper housing and lands on the shoulder of the lower housing, for deflecting the slip member radially inward, forcing the teeth to embed in the conduit.

7. The housing assembly according to claim 6 further comprising:

an annular internal seal located on the cylindrical internal portion of the slip member for sealingly engaging the conduit.

8. The housing assembly according to claim 6 further comprising:

an annular internal seal located on the cylindrical internal portion of the slip member for sealingly engaging the conduit; and an annular external seal located on the lower external conical section of the slip member for sealingly engaging the internal conical section of the lower housing.

9. A housing assembly for connection to conduit of a well, comprising in combination:

a lower housing having an upper end and a bore with a lower internal conical section extending downward from the upper end;

an upward facing annular shoulder in the bore at the upper end of the lower housing;

an upper housing having a lower end and a bore with an upper internal conical section extending upward from the lower end;

a downward facing annular shoulder at the lower end of the bore of the upper housing;

a metal slip member with an upper external conical section, a lower external conical section, and a cylindrical internal portion containing a set of teeth, the slip member being a continuous annular member;

an annular recess formed on the exterior of the slip member between the upper and lower external conical sections;

a retaining ring located in the annular recess and protruding radially outward for engaging the shoulders of the upper and lower housings;

an internal elastomeric seal located on the cylindrical internal portion of the slip member for sealingly engaging the conduit;

a lower external elastomeric seal on the lower external conical section of the slip member for sealingly engaging the internal conical section of the lower housing;

an upper external elastomeric seal on the upper external conical section of the slip member for sealingly engaging the internal conical section of the upper housing;

the slip member being located around the conduit with the upper external conical section above the lower housing and the lower external conical section in mating contact with the lower internal conical section of the lower housing; and means for clamping the upper housing to the lower housing, causing the upper and lower housings to move toward each other without rotation and causing the upper internal conical section of the upper housing to slide downward on the upper external conical section of the slip member until the retaining ring is engaged by the shoulder of the upper housing and lands on the shoulder of the lower housing, for deflecting the slip member radially inward, forcing the teeth to embed in the conduit.

* * * * *

UNITED STATES PATENT AND TRADEMARK OFFICE

CERTIFICATE OF CORRECTION

PATENT NO. : 5,135,266

DATED : 8/4/92

INVENTOR(S) : Charles D. Bridges, Henry Lang

It is certified that error appears in the above-identified patent and that said Letters Patent is hereby corrected as shown below:

At column 1, line 30, after "slips", a period should be inserted.

At column 3, line 21, after "curved", a period should be inserted.

At column 4, line 21, after "15", a period should be inserted.

At column 4, line 42, "159" should be--59--.

Signed and Sealed this

Sixteenth Day of November, 1993

Bruce Lehman

*Attest:*

BRUCE LEHMAN

*Attesting Officer*

*Commissioner of Patents and Trademarks*